US009032569B2

(12) United States Patent
Xu

(10) Patent No.: US 9,032,569 B2
(45) Date of Patent: May 19, 2015

(54) ELECTRIC BED

(71) Applicant: Jianchun Xu, Jiaxing (CN)

(72) Inventor: Jianchun Xu, Jiaxing (CN)

(73) Assignee: SOFTIDE, Jiaxing (CN)

( * ) Notice: Subject to any disclaimer, the term of this patent is extended or adjusted under 35 U.S.C. 154(b) by 0 days.

(21) Appl. No.: 14/300,983

(22) Filed: Jun. 10, 2014

(65) Prior Publication Data

US 2015/0067965 A1 Mar. 12, 2015

(30) Foreign Application Priority Data

Sep. 10, 2013 (CN) ..... 2013 2 05593235 U

(51) Int. Cl.
*A47C 21/04* (2006.01)
*A47C 20/04* (2006.01)
*A61G 7/015* (2006.01)

(52) U.S. Cl.
CPC ..... *A47C 20/041* (2013.01); *A61G 7/015* (2013.01)

(58) Field of Classification Search
CPC ..... A47C 21/04
USPC ..... 5/616–618, 620
See application file for complete search history.

(56) References Cited

U.S. PATENT DOCUMENTS 3,191,196 A * 6/1965 Holm ..... 5/616
2009/0121660 A1* 5/2009 Rawls-Meehan ..... 318/16

* cited by examiner

*Primary Examiner* — Fredrick Conley
(74) *Attorney, Agent, or Firm* — Clement Cheng

(57) ABSTRACT

An electric bed has a bed frame, multiple boards, and a motor structure. The bed frame comprises a lower bed frame and an upper bed frame, and the upper bed frame and the lower bed frame are connected by a connecting structure. The multiple boards are hinged, and at least one board is fixed onto the upper bed frame. The motor structure comprises a connecting rod, a slide bar, and a horizontal pushing motor system. The connecting rod has one end hinged with the first board of the multiple boards. The slide bar extends in the width direction of the bed frame and is arranged in a sliding chute in the length direction of the bed frame, so that it can slide along the length direction of the bed frame.

9 Claims, 3 Drawing Sheets

ELECTRIC BED

This application claims priority from and is a Paris Convention Treaty of non-provisional application of: People's Republic of China utility model patent application 201320559323.5 entitled Electric Bed, filed Sep. 10, 2013, by inventor Xu, Jianchun; the disclosures of which are incorporated herein by reference.

FIELD OF THE INVENTION

The utility model relates to the field of electric furniture, especially an electric bed.

BACKGROUND

Electric beds have become more popular recently. The bed board of a common electric bed comprises multiple boards including: a head board, a fixed board, a leg board, and a foot board, which are sequentially connected together by a hinge, and lifted by a motor driving the bed board. The bed folds and moves to meet the requirements for user postural changes.

Nonetheless, the motor used generally for the electric bed is a linear actuator and its driving mode is simplest original direct driving mode, namely one of the push rod motor is hinged with the bed frame. Another end is hinged with the bed board. The push rod motor directly pushes the bed board and rotates around the hinge joint with the lifting of the bed board. When the push rod motor lifts with the bed board, the push rod continuously changes in direction and position so that the operating condition of the push rod motor is always in a changeable unstable status. In this unstable operating condition, it is possible to cause failure in the push rod motor and accident resulting in injury to the user during use of the electric bed.

SUMMARY OF THE INVENTION

The present invention is an electric bed which eliminates deficiencies of traditional electric beds such as unstable operating conditions of the push rod motor. It is an object of the present invention to provide a motor configuration having a more stable operating condition and prolong service life which would generally improve the application performance of the electric bed.

The electric bed has a bed frame, multiple boards and a motor structure. The bed frame includes a lower bed frame and an upper bed frame. The upper bed frame and the lower bed frame are connected by a connecting structure. The multiple boards are hinged, and at least one board is fixed onto the upper bed frame.

The motor structure has a connecting rod, a slide bar, and a horizontal pushing motor system. The connecting rod has one end hinged with the first board of the multiple boards. The slide bar extends in the width direction of the bed frame and is arranged in a sliding chute in the length direction of the bed frame, so that it can slide in the length direction of the bed frame. Another end of the connecting rod is hinged with the slide bar. The horizontal pushing motor system is horizontally arranged and comprises a fixed end and a free end. The fixed end is arranged below the bed frame, and the free end is hinged with the slide bar. The free end of the horizontal pushing motor system reciprocates between an initial position and a limiting position. In the initial position, the slide bar is not driven and approximately in a horizontal position so that the first board is in the horizontal position. In the limiting position, the slide bar is driven by the free end so that the first board is in the raising position. The first board can be fixed in any position between the horizontal position and the raising position.

Furthermore, when the first board moves from the horizontal position to the raising position, the connecting rod rotates less than 90°. Furthermore, the free end has a fixed part on its end part, and the fixed part is fixedly connected with the slide bar. Furthermore, the horizontal pushing motor system has a position sensor that can sense the position of the free end. Furthermore, the horizontal pushing motor system has a controller and a control circuit. The controller can control the movement and stop the free end using the control circuit. Furthermore, the controller can be a remote control. Furthermore, the horizontal pushing motor system may also have a wireless receiver, which can receive the signal from the wireless remote control and control the movement of the free end by the control circuit.

Furthermore, the motor structure may have a secondary connecting rod, a secondary slide bar and a secondary horizontal pushing motor system. The secondary connecting rod has one end hinged with the second board of the multiple boards. The secondary slide bar is arranged in the width direction of the bed frame and arranged in a sliding chute in the length direction of the bed frame, so that it can slide in the length direction of the bed frame. Another end of the secondary connecting rod is hinged with the secondary slide bar. The secondary horizontal pushing motor system is horizontally arranged and comprises a fixed end and a free end. The fixed end is arranged on the lower bed frame. The free end is hinged with the secondary slide bar so that the bed frame is driven by the secondary slide bar to move relative to the length direction of the bed frame. The free end of the secondary horizontal pushing motor system reciprocates between an initial position and a limiting position. In the initial position, the second board is in the horizontal position, whereas in the limiting position, the second board is in the raising position, and the second board can be fixed in any position between the horizontal position and the raising position.

Furthermore, the motor in the horizontal pushing motor system is a slider motor. The free end is the slider of the slider motor which is fixedly connected with the slide bar so that the slide bar slides relative to the bed frame in the length direction of the bed frame. Furthermore, the connecting structure comprises a guide wheel and a guide slot. The guide wheel is fixed on the upper bed frame and two ends of the slide bar. The guide slot is arranged on the lower bed frame. The guide rail connecting device drives the upper bed frame and the slide bar respectively to roll along the guide slot of the lower bed frame.

The horizontal pushing motor is connected with the slide bar. The slide bar can move in the length direction of the lower bed frame to limit the direction of the horizontal pushing motor to the length direction of the bed frame. Thus, the pressure applied to the bed board by the user is dispersed to the slide bar by the connecting rod, and the pressure is further dispersed to the lower bed frame by the slide bar.

The following callout list of elements can be a useful guide in referencing the elements of the drawings.

1 Electric Bed
2 Motor Structure
3 Horizontal Pushing Motor System
3' Secondary Horizontal Pushing Motor System

4 Connecting Rod
4' Secondary Connecting Rod
5 Free End
5' Secondary Free End
6 Slide Bar
6' Secondary Slide Bar
11 Upper Bed Frame
12 Lower Bed Frame
15 Fixed End
15' Secondary Fixed End
66 Sliding Chute

DETAILED DESCRIPTION OF THE PREFERRED EMBODIMENT

Figure 1:
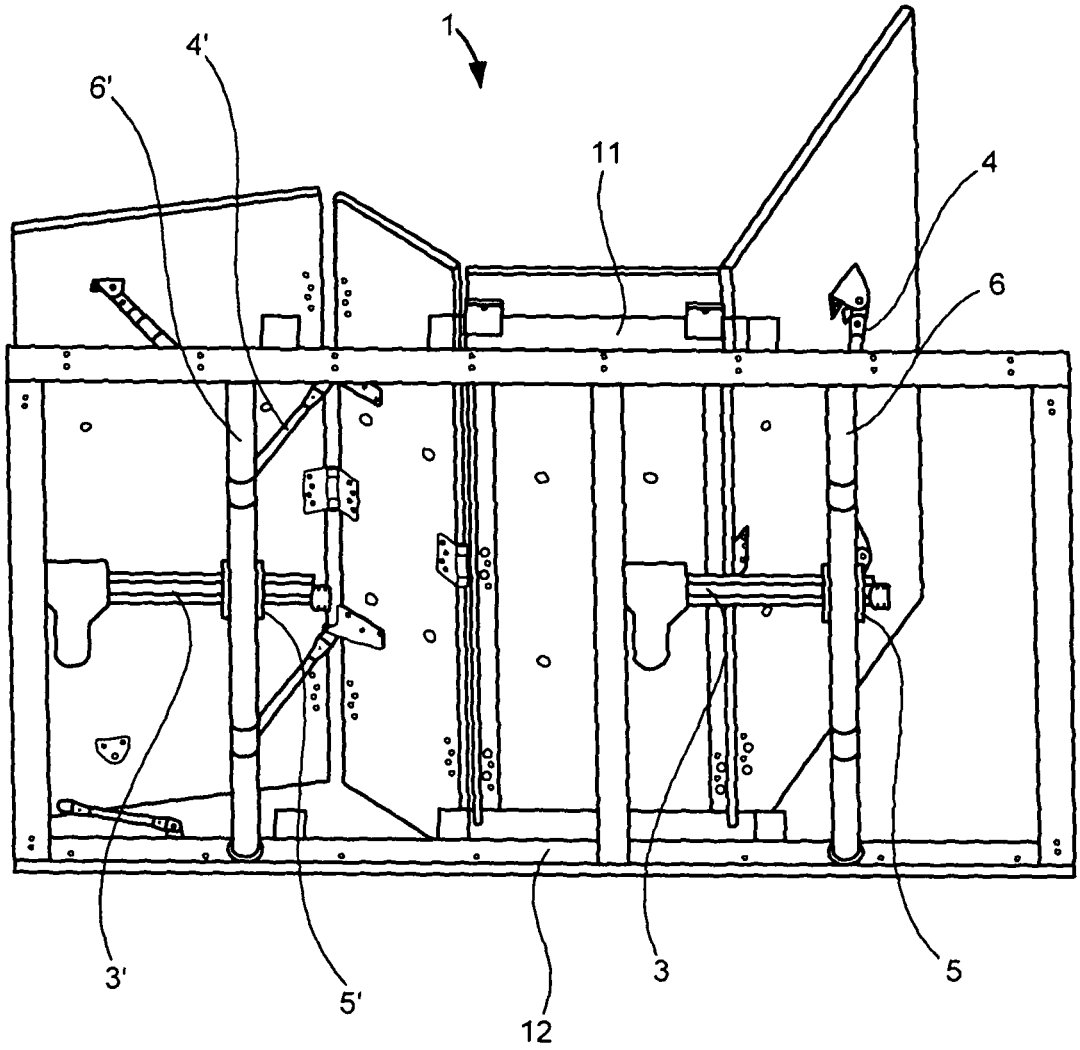
FIG. 1 is a structure diagram of the electric bed in bottom perspective view.
Figure 4:
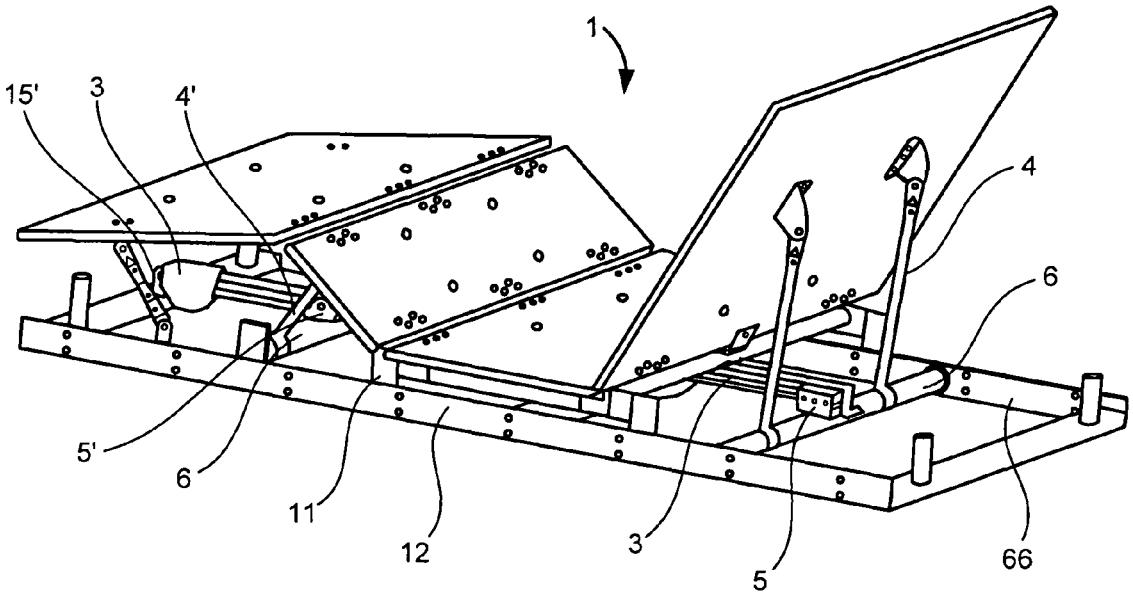
FIG. 4 is a perspective drawing of the electric bed shown in FIG. 1 in diagonal rear direction.

As shown FIGS. 1 and 4, in an embodiment according to the utility model, the electric bed 1 comprises the bed frame, the multiple boards and the motor structure 2. The bed frame comprises the upper bed frame 11 and the lower bed frame 12. The upper bed frame 11 is arranged above the lower bed frame 12. The multiple boards are hinged, and at least one board is fixed onto the upper bed frame 11.

As shown in FIG. 1 the motor structure 2 has a connecting rod 4, a slide bar 6 and a horizontal pushing motor system 3. One end of the connecting rod 4 is hinged with the first board of the multiple boards. For example, the connecting rod 4 is hinged with the first board by a fixing piece affixed on the bed board. Preferably, the first board is adjacent to the board fixed on the upper bed frame 11.

The slide bar 6 is arranged in the width direction of the bed frame and arranged in a sliding chute 66 in the length direction of the bed frame, so that it can slide in the length direction of the bed frame. The slide bar 6 is a round bar. For example, the slide bar may have two ends that have a round end part with a larger diameter than the bar body or provided with a trolley wheel to follow movement along the sliding chute 66 in the length direction of the bed frame. Optionally, the slide bar 6 may be a rectangular tube with a trolley wheel and the like.

One end of the connecting rod 4 is hinged with the slide bar 6. Specifically, one end of the connecting rod 4 has a pivoting part matching the diameter of the slide bar 6, and the connecting rod 4 can rotate the slide bar 6 by the pivoting part. At the same time, the slide bar 6 is further connected with the free end 5 of the horizontal pushing motor system 3 to limit the operating direction of the horizontal pushing motor system 3. Thus, the horizontal pushing motor system 3 has a more stable operating condition, namely it extends and shrinks in the length direction of the lower bed frame 12. Additionally, the free end has a fixed part on its end part, and the fixed part is fixedly connected with the slide bar.

The horizontal pushing motor system 3 is horizontally arranged, and comprises the fixed end 15 and the free end 5. The fixed end 15 is arranged on the lower bed frame 12. Specifically, the lower bed frame 12 is made of a metal material, and at least one metal section has a connecting component for connecting the horizontal pushing motor system 3. The horizontal pushing motor system 3 is fixed on the lower bed frame 12 by the connecting component.

The free end 5 of the horizontal pushing motor system 3 is connected with the slide bar 6 by directing fixed connection mode and the slide bar 6 is held by arranging a holding part on the free end 5. The free end 5 connected with the slide bar 6 contributes to push the slide bar 6 to move relative the bed frame in the length direction of the bed frame. The free end 5 can reciprocate between the initial position and the limiting position. Optionally, the free end 5 is driven by the motor system to move from the initial position to the limiting position, and is driven to the initial position manually or by a resetting device.

Figure 2:
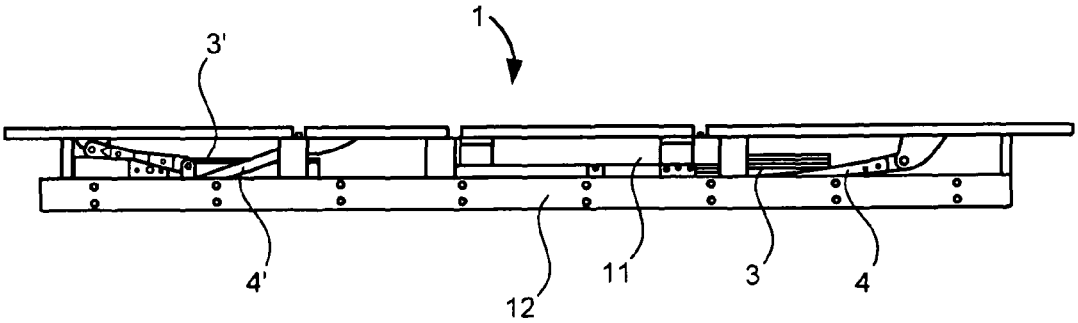
FIG. 2 is a schematic diagram of the bed board of the electric bed in the horizontal position.

As shown in FIG. 2, when the free end 5 is in the initial position, the connecting rod 4 is approximately the horizontal position, and the first board is in the horizontal position.

Figure 3:
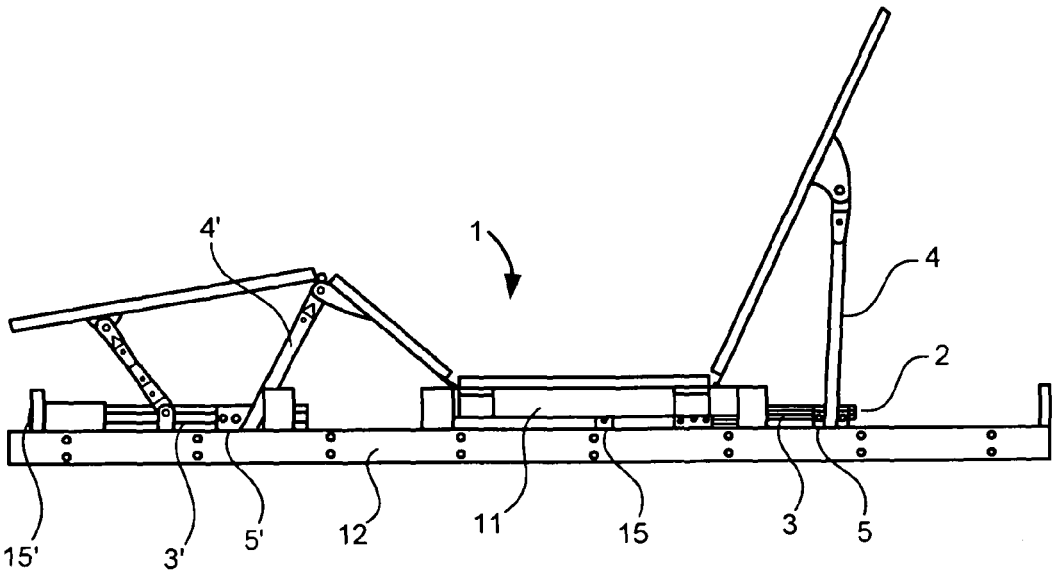
FIG. 3 is a schematic diagram of the bed board of the electric bed in the raising position.

As shown in FIG. 3, when the free end 5 is in the limiting position, the connecting rod 4 is rotated by sliding the slide bar to support, and position the first board in the raising position. The first board is fixed in any position between the horizontal position and the raising position, so that the free end 5 stops in any position between the initial position and the limiting position. The first board is supported and fixed in its current position by the connecting rod 4 according to the user-defined adjustable angle to meet various user postural requirements. Particularly, when the free end 5 moves from the initial position to the limiting position, the connecting rod 4 rotates less than 90°.

Additionally, the motor structure 2 provided in this embodiment further comprises the secondary connecting rod 4', the secondary slide bar 6' and the secondary horizontal pushing motor system 3'. The secondary connecting rod 4' is hinged with the second board of the multiple boards. The secondary slide bar 6' is arranged in the width direction of the bed frame and arranged in a sliding chute 66 in the length direction of the bed frame, so that it can slide in the length direction of the bed frame. Another end of the secondary connecting rod 4' is hinged with the secondary slide bar 6'.

The secondary horizontal pushing motor system 3' is horizontally arranged, and includes the secondary fixed end 15', and the secondary free end 5'. The secondary fixed end 15' of the secondary horizontal pushing motor system 3' is arranged on the lower bed frame 12. The secondary free end 5' of the secondary horizontal pushing motor system 3' is hinged with the second board of the multiple boards by the secondary slide bar 6', which is hinged with the secondary connecting rod 4'. Additionally, the secondary free end 5' of the secondary horizontal pushing motor system 3' can also reciprocate between an initial position and a limiting position. In the initial position, the second board is in the horizontal position. In the limiting position, the second board is in the raising position, and the second board can be fixed in any position between the horizontal position and the raising position.

Additionally, the upper bed frame 11 can be equipped with a guide wheel. A guide rail can be arranged on the lower bed frame 12 to accommodate and guide the guide wheel. The guide wheel forms a connecting structure together with the guide rail. The upper bed frame and the lower bed frame are connected by the connecting structure, and the upper bed frame can translate relative to the lower bed frame. Optionally, the upper bed frame 11 is equipped with a slider. The sliding chute is arranged on the lower bed frame 12 to guide the slider. The slider forms a sliding connecting structure together with the sliding chute. The upper bed frame 11 and the lower bed frame 12 are connected by the sliding connecting structure and the upper bed frame 11 can translate relative to the lower bed frame 12.

Additionally, there are various types of connecting rods. For example, single or multiple connecting rods may be used for the electric beds with various sizes and bed types. The connecting rods could have rectangular or circular, hollow or solid cross sections. The connecting rod may be also straight or bent, and may be connected to any position of the slide bar. The operating principle of all connecting roads is that the connecting rod is driven by the horizontal pushing motor to drive the bed board to the corresponding position, so that raising and falling of the bed board is achieved.

In another embodiment, the horizontal pushing motor system 3 has a position sensor that can sense the position of the free end 5. For example, when the horizontal pushing motor drives the bed board to raise, the position sensor can sense whether the free end 5 arrives in the limiting position. A signal is given to stop the horizontal pushing motor to avoid motor overload while sensing the free end 5 arrives in the limiting position.

In one embodiment, the horizontal pushing motor system 3 also has a controller and a control circuit. The controller controls the operation of the horizontal pushing motor by the control circuit. For example, when the user raises the bed board, the controller may be used to operate the slider motor. The motor drives the free end 5 to move, and the connecting rod 4 hinged with the bed board is driven to move by the slide bar 6, driving the free end 5 in the length direction of the electric bed, so that the bed board arrives in the raising position. The bed board may be folded at user-defined folding angle by the controller and the control circuit.

The controller can be a wireless remote control. For example, the user may transmit the control signal by an infrared remote control, a Bluetooth remote control, or an application program preset in a communication device. Additionally, the horizontal pushing motor system 3 could also have a wireless receiver that can receive the signal transmitted from the remote control, and the free end 5 can be controlled to move by the control circuit.

Although the present invention is illustrated and described herein, a person of ordinary skill in the art may make obvious modifications within the scope of the following claims.

The invention claimed is:

1. An electric bed comprising:

a. a bed frame;

b. multiple boards;

c. a motor structure, wherein the bed frame comprises a lower bed frame and an upper bed frame, and wherein the upper bed frame and the lower bed frame are connected by a connecting structure, wherein the multiple boards are hinged, d. a fixed board that is fixed onto the upper bed frame, wherein at least one board of the multiple boards is fixed onto the upper bed frame, wherein the motor structure comprises:

e. a connecting rod, having a connecting rod end that is hinged with the slide bar;

f. a slide bar, wherein the motor structure actuates the slide bar; and g. a horizontal pushing motor system, wherein the connecting rod has one end hinged with the first board of the multiple boards; wherein the slide bar extends in a width direction of the bed frame and is arranged in a sliding chute in the length direction of the bed frame, so that it can slide in the length direction of the bed frame, wherein another end of the connecting rod is hinged with the slide bar; wherein the horizontal pushing motor system, is horizontally arranged and comprises a fixed end and a free end, wherein the fixed end is arranged below the bed frame, and the free end is hinged with the slide bar; wherein the free end of the horizontal pushing motor system reciprocates between an initial position and a limiting position, wherein in the initial position the slide bar is not driven and is approximately in a horizontal position so that the first board is in the horizontal position, wherein in the limiting position the slide bar is driven by the free end so that the first board is in the raising position, and the first board can be fixed in any position between the horizontal position and the raising position;

h. a secondary connecting rod;

i. a secondary slide bar; and j. a secondary horizontal pushing motor system, wherein the secondary connecting rod has one end hinged with the second board of the multiple boards; wherein the secondary slide bar is arranged in the width direction of the bed frame and arranged in a sliding chute in the length direction of the bed frame, so that it can slide in the length direction of the bed frame, wherein another end of the secondary connecting rod is hinged with the secondary slide bar, wherein the secondary horizontal pushing motor system is horizontally arranged and comprises a fixed end and a free end, wherein the fixed end is arranged on the lower bed frame, and the free end is hinged with the secondary slide bar so that the bed frame is driven by the secondary slide bar to move relative to the length direction of the bed frame, wherein the free end of the secondary horizontal pushing motor system reciprocates between an initial position and a limiting position wherein in the initial position the second board is in the horizontal position, whereas in the limiting position the second board is in the raising position, and wherein the second board can be fixed in any position between the horizontal position and the raising position; wherein the horizontal pushing motor system has a first motor and the secondary horizontal pushing motor system has a second motor, wherein the first motor is connected to the bed frame underneath the fixed board, and wherein the second motor is connected to the bed frame underneath a second board.

2. The electric bed of claim 1, wherein, the connecting structure comprises a guide wheel and a guide slot, wherein the guide wheel is fixed on the upper bed frame and two ends of the slide bar, the guide slot is arranged on the lower bed frame, wherein a guide rail connecting device drives the upper bed frame and the slide bar respectively to roll along the guide slot of the lower bed frame.

3. The electric bed of claim 1, wherein, when the first board moves from the horizontal position to the raising position, the connecting rod rotates less than 90°.

4. The electric bed of claim 1, wherein, the free end has a fixed part on its end part, and the fixed part is fixedly connected with the slide bar.

5. The electric bed of claim 1, wherein, the horizontal pushing motor system has a position sensor that can sense the position of the free end.

6. The electric bed of claim 1, wherein, the horizontal pushing motor system further comprises a controller and a control circuit, and the controller can control the movement and stop the free end using the control circuit.

7. The electric bed of claim 1, wherein, the controller is a remote control.

8. The electric bed of claim 1, wherein, the horizontal pushing motor system further comprises a wireless receiver, which can receive the signal from the wireless remote control and controls the movement of the free end by the control circuit.

9. The electric bed of claim 1, wherein, the motor in the horizontal pushing motor system is a slider motor, wherein the free end is the slider of the slider motor which is fixedly connected with the slide bar so that the slide bar slides relative to the bed frame in the length direction of the bed frame.

* * * * *